US007114195B1

(12) United States Patent
Grandison

(10) Patent No.: US 7,114,195 B1
(45) Date of Patent: Oct. 3, 2006

(54) NEONATE WARMTH STOCKING CAP

(76) Inventor: Ilene Devoney Grandison, 7016 SW. 40th St., Miramar, FL (US) 33023

( * ) Notice: Subject to any disclaimer, the term of this patent is extended or adjusted under 35 U.S.C. 154(b) by 0 days.

(21) Appl. No.: 11/201,062

(22) Filed: Aug. 11, 2005

(51) Int. Cl.
*A42B 1/04* (2006.01)

(52) U.S. Cl. ..... 2/204; 2/195.3; 2/175.3; 2/209.4; 2/209.11; 2/174; 2/171.8; 2/171.3

(58) Field of Classification Search ..... 2/195.3, 2/175.3, 209.4, 209.11, 204, 174, 171.8, 171.3
See application file for complete search history.

(56) References Cited

U.S. PATENT DOCUMENTS 3,740,767 A * 6/1973 Schuessler ..... 2/173
5,890,230 A * 4/1999 Guo ..... 2/175.1
6,131,203 A * 10/2000 Cominsky ..... 2/202
D495,057 S * 8/2004 McCoy ..... D24/191
D496,775 S * 10/2004 Tanner ..... D2/889
6,948,189 B1 * 9/2005 Early ..... 2/184.5

* cited by examiner

*Primary Examiner*—John J. Calvert
*Assistant Examiner*—Alissa J. Tompkins
(74) *Attorney, Agent, or Firm*—Robert J. Van Der Wall

(57) ABSTRACT

Disclosed is a preemie warmth stocking cap comprised preferably of several components including in a multilayered construction two layers of a woven or knitted stretchable but resilient fabric, such as cotton, which forms an outer and inner layer between which is disposed a thin and flexible insulating plastic layer to minimize heat loss that is readily deformable, but not readily breakable and which includes an adhesive to achieve positional stability between the plastic layer and an adjoining fabric layer. A third optional component is comprised of a clamping structure comprised of an inert material used to close the top of tubular fabric about the top of the infant's head if the fabric layers are made with a tubular stockinette.

19 Claims, 2 Drawing Sheets

NEONATE WARMTH STOCKING CAP

BACKGROUND TO THE INVENTION

1. Field of the Invention

The present invention relates generally to the field of neonatal infant care. More specifically, it refers to an apparatus or device in the form of an insulated stocking cap applied to the head of prematurely delivered infants, sometimes referred to as "preemies." The invention is directed to the head of such infants in a manner to provide warmth. This actually occurs because the inventive device acts as an insulator to minimize heat loss caused by the higher body temperature of the infant compared to the lower ambient temperature.

2. Description of the Prior Art

During primarily the last half of the twentieth century and the beginning of the present one, enormous strides have been made in the ability of medical science to save the lives and nurture the successful development of prematurely delivered infants. Such achievements frequently result in part from the use of sophisticated high tech neonatal equipment, including that which monitors and controls the infants' environment.

For example, there is a plethora of prior art references that describe incubators and the like. Like the present invention, there are also prior art patents addressing infants' environment that are relatively low tech. A sampling include Simbruner, et al., U.S. Pat. No. 6,228,106 which discloses a thermal suit for a premature baby, Sims, U.S. Pat. No. 6,839,924 which discloses a blanket and method for swaddling an infant, and Lunt, U.S. Pat. No. 4,897,885 which discloses a one-piece infant bunting.

SUMMARY OF THE INVENTION

Bearing in mind the foregoing, it is a principle object of the present invention to provide a disposable warmth stocking cap for premature infants in neonatal care.

Another principal object of the present invention is to provide a multilayered structure that combines the features of protection for the infant, softness to the touch, deformability to accommodate the infant size, and an insulating layer to minimize heat loss from the infant's head.

Another object of the invention is to provide a multilayered warmth stocking cap comprised of very common and inexpensive materials that renders disposability of the product economical.

An additional object of the invention is to achieve warmth for an infant's head by minimizing heat loss resulting from the differential in temperature from the body temperature of the infant and the ambient environment.

A related object of the invention is to achieve the foregoing objective using a thin layer of plastic that acts as an insulator to deter heat loss.

A further related object of the invention is to encapsulate the plastic and the formable insulating layer from contact with the infant by completely enclosing that plastic layer within an outside layer of a woven or knitted stretchable and resilient fabric that is soft to the touch and protective to the infant.

Another object of the invention is to provide a structure that is suitable for both medical equipment vendor manufacture and sale, as well as construction on site by medical care givers from materials that are readily available commercially.

Other objects and advantages will be apparent to those skilled in the art upon reference to the following descriptions and the appended drawings.

As noted above, the present invention is a low tech companion for the foregoing incubators and other sophisticated equipment. It is a stocking cap for a premature infant that has been found to be quite efficacious by neonatal nurses in part because of its simplicity. Normally an infant will be covered up to its neck by a warming enclosure of some type, such as a suit, a blanket or the like, leaving its head exposed for breathing and observation by the medical care staff. Thus, the head of the infant is normally exposed to ambient temperature which is usually lower than body temperature. It is therefore logical to apply a covering to the head of a premature or other infant.

Moreover, the efficiency of such a stocking cap in preventing heat loss is enhanced when it is comprised of a multilayered structure having as outer layers a woven or knitted fabric that is stretchable, resilient and soft to the touch in combination with an inner layer that is a very thin and lightweight plastic layer (or more) that is deformable structurally but insulating in character. The deformability allows the stocking cap to be readily sized by a nurse or other caregiver to the head of the infant while at the same time the outer layer is soft to the touch, protective to the infant, and the combined structure is extremely inexpensive so as to permit cost effective disposability of the inventive device.

In accordance with the primary aspect of the present invention, there is provided a preemie warmth stocking cap comprised preferably of two or three components including in a multilayered construction two layers of a woven or knitted stretchable but resilient fabric, such as cotton, which forms an outer and inner layer of the preferable multilayered structure. The second component is a thin and flexible plastic layer that is readily deformable, but not readily breakable, which is interposed between the inner and outer layers of the foregoing fabric. The second component preferably includes means to fix placement of the second component with respect to the location of the first component to achieve positional stability between the first and second components, such as can be achieved using an adhesive. The adhesive is preferably a pressure sensitive adhesive that is removable from fabric to optimize placement of the plastic layer with respect to a layer of fabric. The third optional component is comprised of a clamping structure of some type comprised of an inert material used to close the top of tubular fabric about the top of the infant's head. The structure of the third component may be comprised of a piece of yarn, coiled up rubber band or the like, and is typically provided when the stocking cap utilizes a tubular fabric as the first component. The tubular fabric forms both an outer layer and an inner layer on both sides of the plastic layer. The three layer "sandwich" is then preferably folded upward as a band about the infant's head with the top of the "sandwich" being closed as described above.

The present invention contemplates several methods of fabrication of the stocking cap. The first method is for the preferred embodiment of the stocking caps to be manufactured by a medical equipment vendor for purchase and use by medical care providers usually in a neonatal unit in a hospital. In this fabrication approach, the plastic layer is custom engineered to achieve three objectives: (1) to optimize insulative effects by minimizing heat transfer through the layer; (2) to have a thin enough cross section to achieve maximum flexibility and adequate deformability to fit the stocking cap to the size of the infant's head; and (3) to include an adhesive to the plastic layer that achieves positional stability with respect to the inner layer so that the plastic layer does not slip out of position leaving a portion of the stocking cap without the insulating effects. The adhesive must be acceptable for use in a neonatal environment. The fabric inner and outer layers must meet the same standard for use in a neonatal environment and can be custom woven or fabricated from commercially available cotton tubular nonsterile stockinette, such as is sold by Albahealth LLC of Rookwood, Tenn. When the invention is manufactured by a medical equipment vendor, it can be fabricated with or without the stockinette tubing described above because the stocking cap can be woven into a structure closed at the top, thus avoiding the need for the third component.

An alternative embodiment contemplates the fabrication of the stocking cap on site by neonatal nurses or other health care workers. In addition to the use of the commercially available cotton tubular nonsterile stockinette in the on site fabrication embodiment, experience has taught that the plastic layer can be effectively created from another commercially available product, namely a storage wrap material such as made pursuant to a plurality of patents owned by the Proctor and Gamble Company of Cincinnati, Ohio. The patents in question include U.S. Pat. Nos. 6,194,062, 6,489,022, and 5,662,758, all by Hamilton et al., and 5,965,235 by McGuire et al. This product is sold using the Glad Products Company's trademarks "Glad," "Press'n Seal" and "Griptex." This storage wrap material includes a pressure sensitive adhesive that is readily removable from fabric to faciliate trial and error placement of the plastic with respect to at one of the fabric layers.

BRIEF DESCRIPTION OF DRAWINGS

Various other features of the invention will become apparent to those skilled in the art from the following discussion taken in conjunction with the appended drawings, in which.

DETAILED DESCRIPTION OF THE PREFERRED EMBODIMENTS

Figure 1:
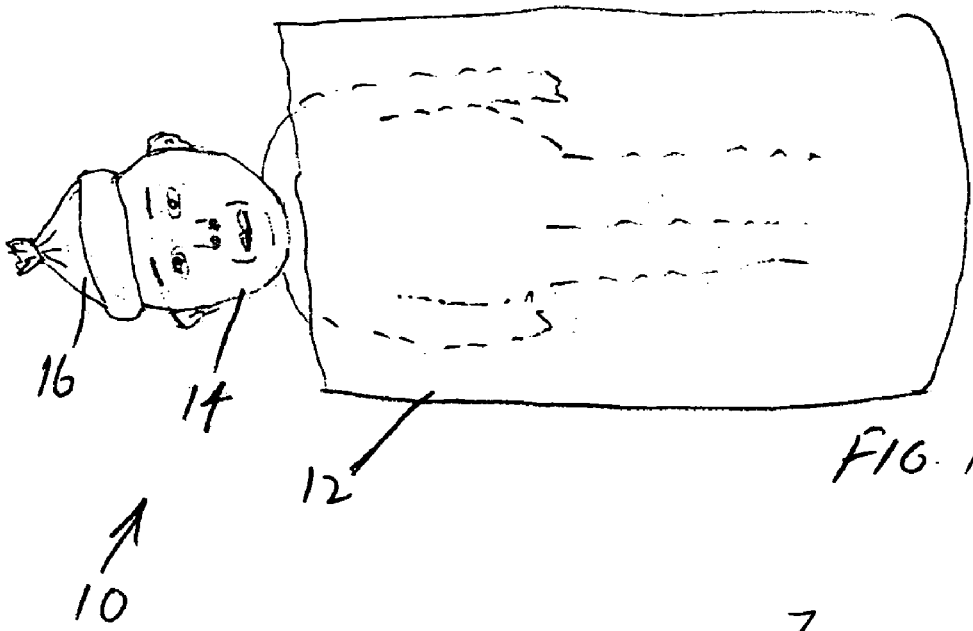
FIG. 1 is a top plan view of an infant covered by a blanket and wearing on its head the stocking cap.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various figures are designated by the same reference numerals.

FIG. 1 is a top plan view of an infant 10 covered by a blanket 12 and wearing on its head 14 the inventive stocking cap 16.

Figure 2:
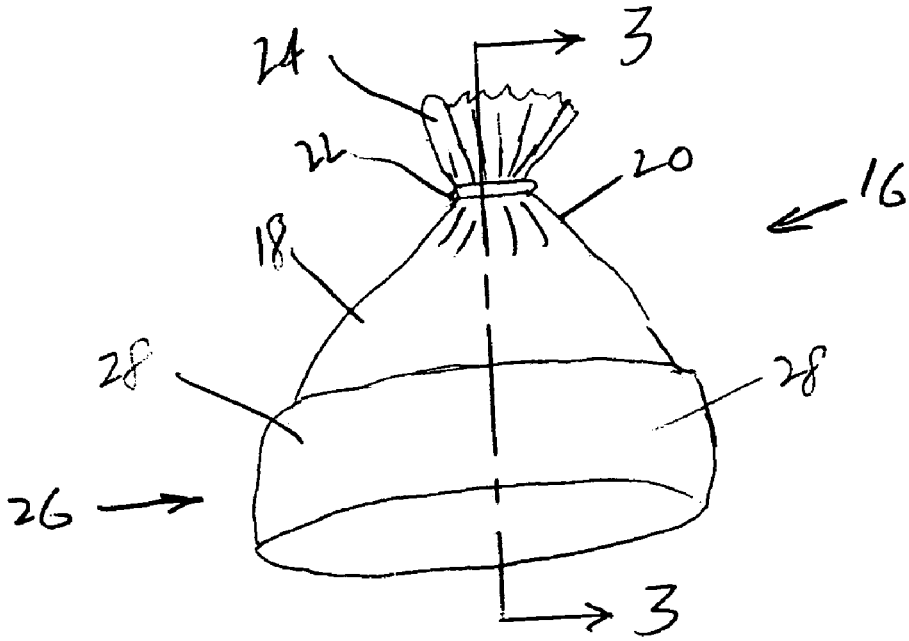
FIG. 2 is an enlarged perspective view of the stocking cap on the head of the infant in FIG. 1.

FIG. 2 is an enlarged perspective view of the stocking cap 16 on the head 14 of the infant 12 as seen in FIG. 1. The warming cap is comprised of multilayered construction two layers of a woven or knitted stretchable but resilient fabric, such as cotton, which forms an outer and inner layer of the preferable multilayered structure 18. When the multilayered structure 18 is formed using a tubular material, near the top or crown 20 of the warming stocking cap 16, the tubular material is gathered and held together with a clamp 22 to close off the top of the stocking cap 16 leaving tubular ends 24 above the clamp 22. At the bottom 26 of the stocking cap 16, the multilayered structure 18 is preferably folded up upon itself to form a band 28.

Figure 3:
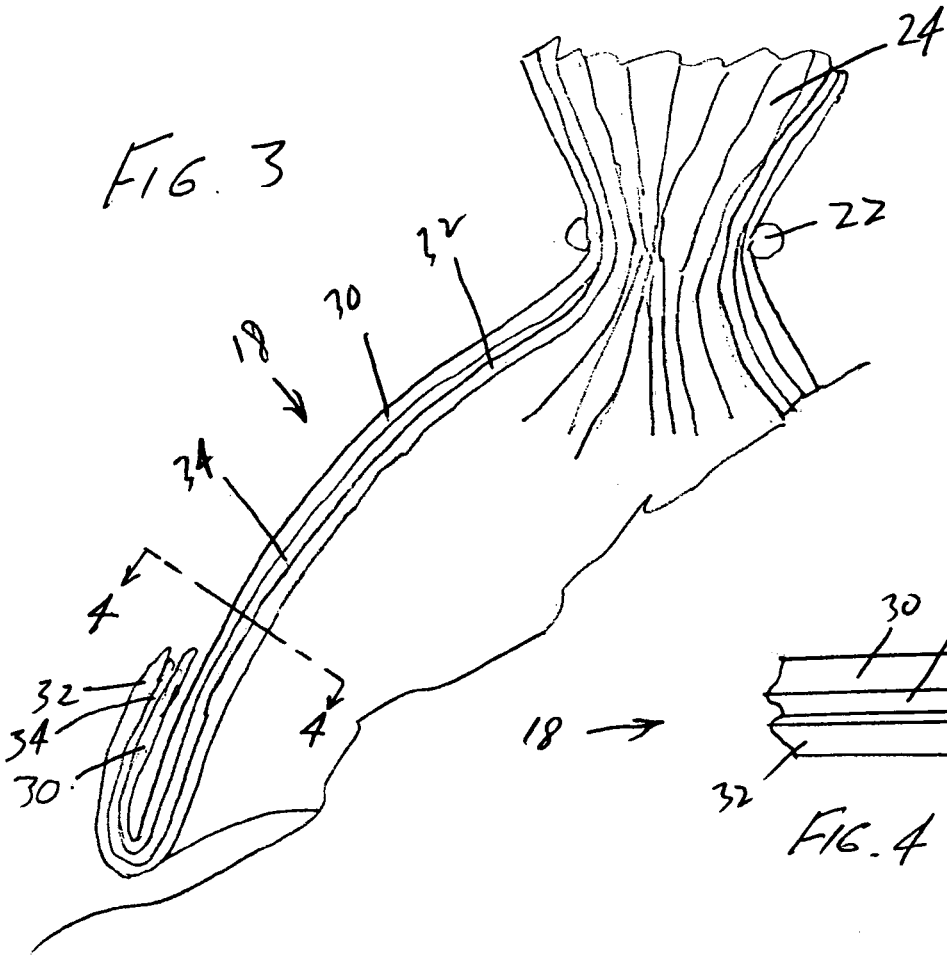
FIG. 3 is a further enlarged fragmentary cross-sectional view of the inventive stocking cap taken along the line 3—3 of FIG. 2.

FIG. 3 is a further enlarged fragmentary cross-sectional view of the inventive stocking cap taken along the line 3—3 of FIG. 2. In this view, the principal layers of the multilayered structure 18 are visible. Outer layer 30 and inner layer 32 form a sandwich with second component 34. The second component 34 is a thin and flexible plastic layer that is readily deformable, but not readily breakable, which is interposed between the outer layer 30 and inner layer 32 of the multilayer structure 18.

Figure 4:
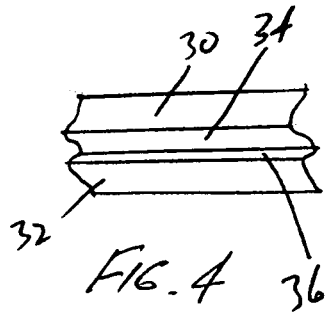
FIG. 4 is an even further enlarged fragmentary view, showing a cross-sectional view taken along the line 4—4 of FIG. 3 illustrating the layers in the multilayer structure of the inventive stocking cap.

FIG. 4 is an even further enlarged fragmentary view, showing a cross-sectional view taken along the line 4—4 of FIG. 3 illustrating in detail the layers in the multilayer structure 18. Seen are outer layer 30, inner layer 32, and plastic layer 34. The plastic layer 34 preferably includes means to achieve positional stability between the outer layer 30 and inner layer 32, such as can be achieved using adhesive 36. It should be noted that adhesive 36 is illustrated between plastic layer 34 and inner layer 32, but it may be alternatively be disposed between plastic layer 34 and outer layer 30, or further alternatively disposed in both locations. Adhesive 36 is preferably a pressure sensitive adhesive whose adhesive qualities vary with the degree of pressure applied thereto. The adhesive 36 is preferably also readily removable from fabric to facilate trial and error placement of the plastic layer with respect to one of the fabric layers when assembly of the invention is made on site by neonatal health caregivers as described above.

Figure 5:
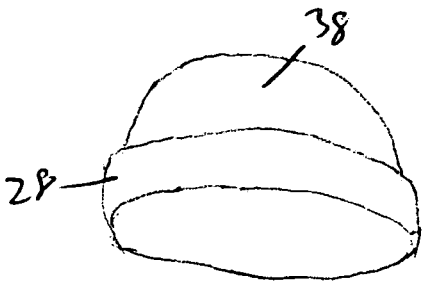
FIG. 5 is an enlarged perspective view of the stocking cap with a closed top as manufactured by a medical equipment vendor.

FIG. 5 is an enlarged perspective view of the stocking cap 16 with a closed top 38 as may be manufactured by a medical equipment vendor with a band 28.

Figure 6:
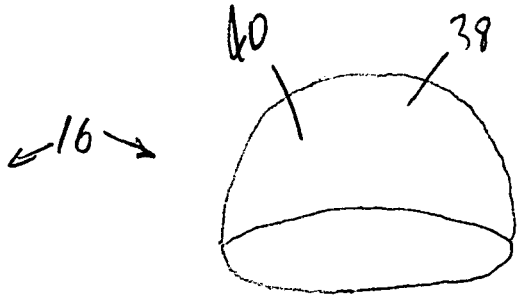
FIG. 6 is alternative embodiment of the stocking cap of FIG. 5.

FIG. 6 is alternative embodiment of the stocking cap 16 of FIG. 5. In this embodiment, there is also a closed top 38, but the stocking cap 16 is fabricated as by a medical equipment vendor without the band 28 of FIG. 5 in the form of a skull cap 40.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A neonate warmth stocking cap comprising:

a multilayer structure to cover a top of an infant's head having an insulating plastic layer to deter heat loss, said layer being a plastic that is readily deformable to fit size and shape of the infant's head;

a resilient fabric layer to conform to the size and shape of the top of the infant's head; and an adhesive layer disposed between the plastic layer and the resilient fabric layer that selectively and removably attaches substantially the entire surface of insulating plastic layer to the fabric layer.

2. The apparatus of claim 1 which further comprises fabric layers on both sides of the plastic layer.

3. The apparatus of claim 2 in which positional stability between the plastic layer and at least one fabric layer is maintained by the adhesive layer disposed between the plastic layer and the fabric layer.

4. The apparatus of claim 3 in which the multilayer structure near its lower edge is folded up to form a band around a circumference of the infant's head.

5. The apparatus of claim 2 in which the fabric layers are made of a soft woven or knitted stretchable but resilient fabric stockinette tubing.

6. The apparatus of claim 5 in which the stockinette tubing is closed at the top of the infant's head with a clamp.

7. The apparatus of claim 6 in which the clamp is comprised of a piece of yarn.

8. The apparatus of claim 6 in which the clamp is comprised of a rubber band.

9. The apparatus of claim 2 in which the plastic layer includes three features: (1) it optimizes insulative effects by minimizing heat transfer through the plastic layer; (2) it has a thin enough cross section to achieve maximum flexibility and adequate deformability to fit the stocking cap to the size and shape of the infant's head; and (3) it includes an adhesive to the plastic layer that achieves positional stability with respect to a fabric layer so that the plastic layer does not slip out of position leaving a portion of the stocking cap without the insulating effects.

10. The apparatus of claim 6 in which the stockinette tubing, the clamp, and the plastic layer having an adhesive applied thereto are commercially available to facilitate the fabrication of the inventive apparatus and fitting thereof to the head of an infant in a neonatal unit by medical caregivers.

11. The apparatus of claim 3 in which the fabric layers are made of a soft and woven or knitted stretchable but resilient fabric with a plastic layer therebetween formed with a closed crown by a medical equipment vendor.

12. A neonate warmth stocking cap comprising:

a multilayer structure to cover a top of an infant's head having at least one insulating plastic layer to deter heat loss that is deformable to fit the size and shape of the infant's head;

resilient fabric layers on both sides of the plastic layer; and an adhesive layer disposed between the plastic layer and at least one of the fabric layers to selectively and removably attach substantially the entire surface of the plastic layer to one of the fabric layers.

13. The apparatus of claim 12 in which the multilayer structure near its lower edge is folded up to form a band around a circumference of the infant's head.

14. The apparatus of claim 12 in which the fabric layers are made of a soft and woven or knitted stretchable but resilient fabric stockinette tubing.

15. The apparatus of claim 14 in which the stockinette tubing is closed at the top of the infant's head with a clamp.

16. The apparatus of claim 15 in which the clamp is comprised of a piece of yarn.

17. The apparatus of claim 15 in which the clamp is comprised of a rubber band.

18. The apparatus of claim 12 in which the plastic layer includes three features: (1) it optimizes insulative effects by minimizing heat transfer through the plastic layer; (2) it has a thin enough cross section to achieve maximum flexibility and adequate deformability to fit the stocking cap to the size and shape of the infant's head; and (3) it includes an adhesive to the plastic layer that achieves positional stability with respect to a fabric layer so that the plastic layer does not slip out of position leaving a portion of the stocking cap without the insulating effects.

19. A neonate warmth stocking cap comprising:

a multilayer structure to cover a top of an infant's head including a first resilient fabric layer;

a plastic layer having the features of optimal insulative effects by minimizing heat transfer therethrough, a thin enough cross section to achieve maximum flexibility and adequate deformability to fit the stocking cap to the size and shape of the infant's head, and including a removable adhesive to achieve positional stability with respect to the first fabric layer so that the plastic layer does not slip out of position leaving a portion of the stocking cap without the insulating effects;

a second resilient fabric layer on an opposite side of the plastic layer from the first resilient fabric layer; and a removable adhesive disposed between the plastic layer and at least one of the fabric layers to maintain positional stability between the plastic layer and at least one fabric layer.

* * * * *